United States Patent [19]

Miyoshi et al.

[11] Patent Number: 4,836,421

[45] Date of Patent: Jun. 6, 1989

[54] TRANSPORTABLE HOPPER AND TANK ASSEMBLY

[75] Inventors: Masazumi Miyoshi, Tokyo; Muneo Isayama, Oami-shirasato; Shoichi Midorikawa, Shirako; Akitada Ota, Sakura, all of Japan

[73] Assignee: ISE Kaguku Kogyo Kabushiki Gaisha, Tokyo, Japan

[21] Appl. No.: 240,384

[22] Filed: Aug. 31, 1988

Related U.S. Application Data

[63] Continuation of Ser. No. 873,520, Jun. 12, 1986, abandoned.

[30] Foreign Application Priority Data

Dec. 12, 1985 [JP] Japan ..... 60-190336[U]

[51] Int. Cl.[4] ..... B67D 5/64

[52] U.S. Cl. ..... 222/166; 222/181; 206/598; 220/254

[58] Field of Search ..... 220/1.5, 70.1, 254; 206/386, 596, 598–599, 511; 222/164, 166, 180–181, 185, 226, 233–235, 311, 367–368, 459, 481–482, 552, 563, 608, 610

[56] References Cited

U.S. PATENT DOCUMENTS

| | | | |
|---|---|---|---|
| 774,774 | 11/1904 | McLeod | 222/238 |
| 1,071,482 | 8/1913 | Umholtz | 222/238 |
| 1,605,416 | 11/1926 | Willoughby | 220/254 |
| 2,978,004 | 4/1961 | Smith | 220/254 X |
| 3,086,679 | 4/1963 | Bijvoet | 220/254 X |
| 3,193,150 | 7/1965 | Simas | 222/166 |
| 3,198,395 | 8/1965 | McKinney | 222/181 X |
| 3,460,718 | 8/1969 | Plant | 206/599 X |
| 3,730,396 | 5/1973 | Harper et al. | 222/166 |

FOREIGN PATENT DOCUMENTS

| | | | |
|---|---|---|---|
| 686316 | 5/1964 | Canada | 220/1.5 |
| 2091206 | 7/1982 | United Kingdom | 206/598 |

*Primary Examiner*—Michael S. Huppert

*Attorney, Agent, or Firm*—Oblon, Fisher, Spivak, McClelland & Maier

[57] ABSTRACT

A transportable hopper and tank positionable in an upright or a reclined position, which includes a tank side wall, a cover body located at a top end portion of the side wall when the tank is in the upright position, a discharging port formed in a lower portion of the tank in the upright position and having an area smaller than the cover body, and a discharge valve located adjacent the discharging port wherein the side wall includes an upper and lower vertical side wall and a second lower side wall positioned opposite the lower vertical side wall wherein the second lower side wall converges downwardly toward the lower vertical side wall when the tank is in the upright position.

1 Claim, 6 Drawing Sheets

TRANSPORTABLE HOPPER AND TANK ASSEMBLY

This application is a continuation of application Ser. No. 06/873,520 filed on June 12, 1986, now abandoned.

BACKGROUND OF THE INVENTION

1. Field of the Invention

The present invention relates to a transportable hopper and tank assembly, especially for the transportation of iodine.

2. Discussion of the Background

Iodine is generally handled in the form of flakes, crystals, lumps, powder or grain made by solidifying the melt of iodine by cooling.

Because of the ease of becoming caked after packaging, the iodine in the above noted form is difficult to be transported. Therefore, only a small amount of iodine has in the past been packed in each bottle for transportation.

Accordingly, the applicant of the present invention has already proposed a globular form of iodine in Japanese patent application No. 124528 filed in 1983. This type of iodine is not attached with partially sublimated and powdered iodine on the grain surface, and therefore caking can normally be avoided.

However, even with this globular form, there is still a danger of caking of the iodine when transported in large quantities, therefore, only small package transportation is allowable.

SUMMARY OF THE INVENTION

Therefore, the present invention is intended to offer a hopper which is used as a container for transportation of iodine so as to be less subject to caking, and should caking occur, the iodine can be easily discharged from the hopper.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
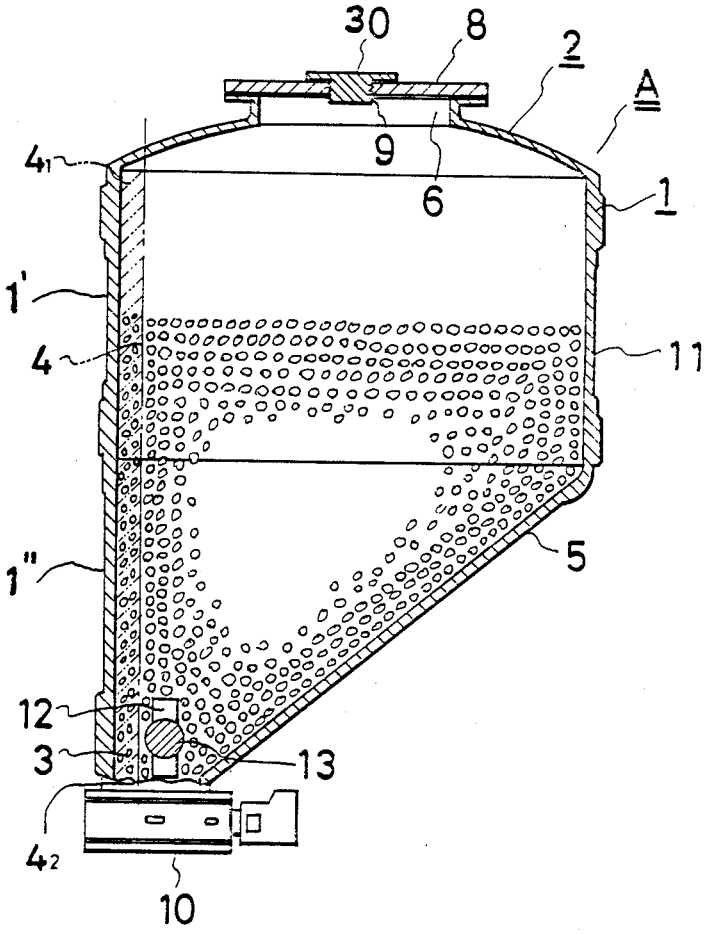
FIG. 1 is a longitudinal sectional elevational view of the hopper combined with tank of the exemplary embodiment of this invention under discharging working conditions.

The hopper combined with the tank of the present invention, forms a vertical line portion 4 with respect to an upper and lower vertical side wall part 1', 1'' of the side wall 1, and the cover body 2 which can serve as a sealing cover is positioned adjacent top end $4_1$ of the upper vertical side wall part 1'and has an opening 6 formed thereon. Discharging port 3, which has a smaller area than the cover body 2 and is equipped with a valve 10, positioned adjacent the bottom end of the lower vertical side wall 1''. The opposite side wall 1 connecting to the cover body 2 and located opposite vertical line portion 4 is oriented parallel with the vertical line portion 4 along a certain length 1, then connects with the side wall 5 which gradually tapers or converges toward the discharging port 3.

In this invention, after iodine is loaded in the container, transportation can occur by orienting or reclining the side wall 1 parallel with floor, thus placing the discharging port 3 at an upper side of the reducing tank A. In this case, iodine will be filled so as to be positioned at a level lower than the discharging port 3. When discharging iodine, the container is shifted to assume the vertical portion of FIG. 1 so that side wall 1 is placed vertical with respect the floor, and after being installed at the facility, valve 10 is opened to discharge the iodine.

An exemplary embodiment of this invention is explained in detail with reference to FIG. 1 through FIG. 3, wherein a hopper combined with tank A is made of synthetic resin and a cover body 2 is positioned adjacent an end of the side wall 1 formed generally to cylindrical form, and discharging port 3 is located adjacent the other end. The side wall 1 has vertical line portion 4 and the cover body 2 forms a continuation of the top end $4_1$ of the vertical line portion 4. Adjacent the bottom end $4_2$ of the vertical line portion 4 is located discharging port 3 which is a smaller area than the above noted cover body 2. The side wall 1 connecting to the cover body 2 and a vertical wall in an upright position of tank A is parallel with the vertical line portion 4 for a certain length 1 from the said top end $4_1$, then connects to side wall 5 which converges gradually toward the discharging port 3.

The cover body 2 is made by fixing a cover plate 8 having a flange 7 connected to the outer circumference of the opening 6 having a large opening area, wherein the cover plate 8 has a smaller opening formed therein for a filler port 9 into which is screw tightened a sealing plug 30.

Moreover, at the lower end of the discharging port 3 is positioned a valve 10, which may be a butterfly valve or equivalent and which is installed for the sealing and discharging of iodine 11. Adjacent the inner wall in proximity to the discharging port 3, a paddle bar 13 having a paddle plate, 12 is installed horizontally, one end of which is projected through the side wall 1 to allow the paddling bar rotated by a handle (not shown) or any other means to promote the discharge of iodine 11.

Figure 2:
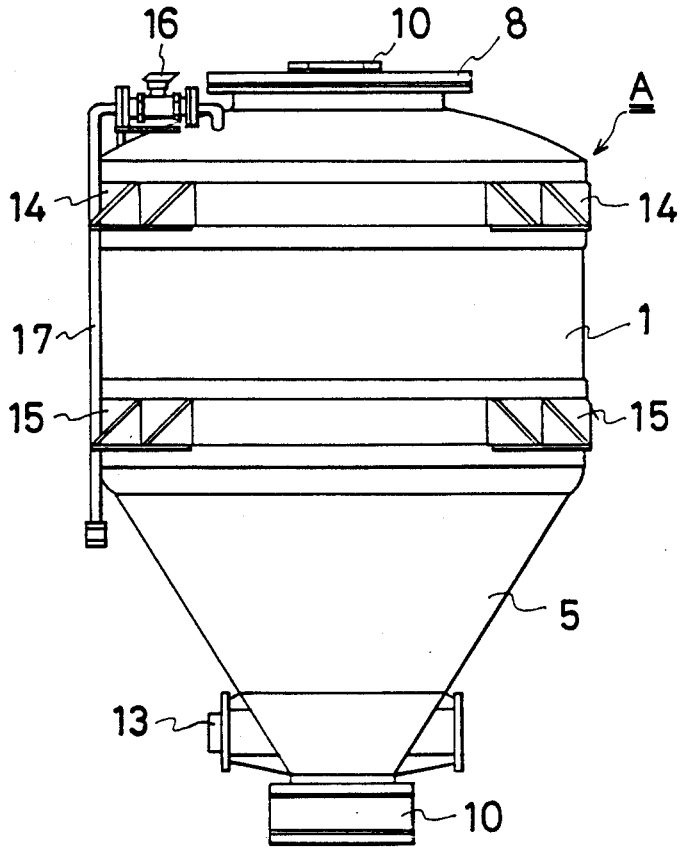
FIG. 2 is a side view of the hopper.
Figure 4:
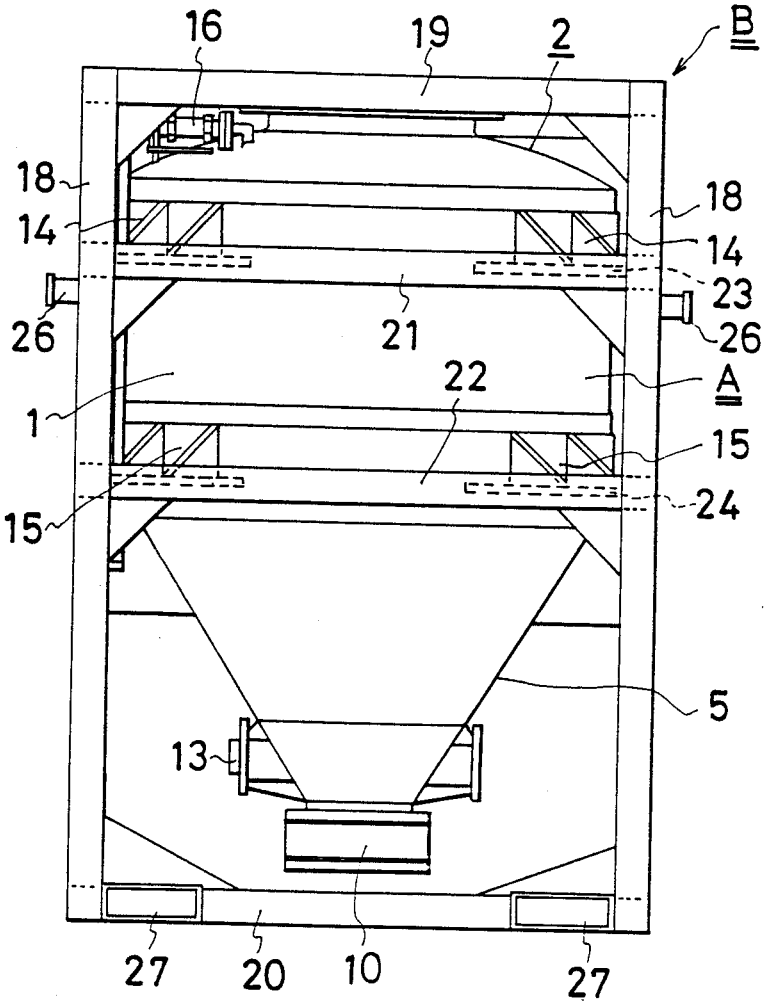
FIG. 4 is a side view of the frame body.

Further in FIG. 2 and FIG. 4, symbols 14, 14, 15,15, denote bracket members connected to four upper and lower portions of the side wall 1, respectively, 16 represents a valve, and 17 denotes a duct which is utilized to introduce $N_2$ gas into the hopper combined with tank A.

Figure 3:
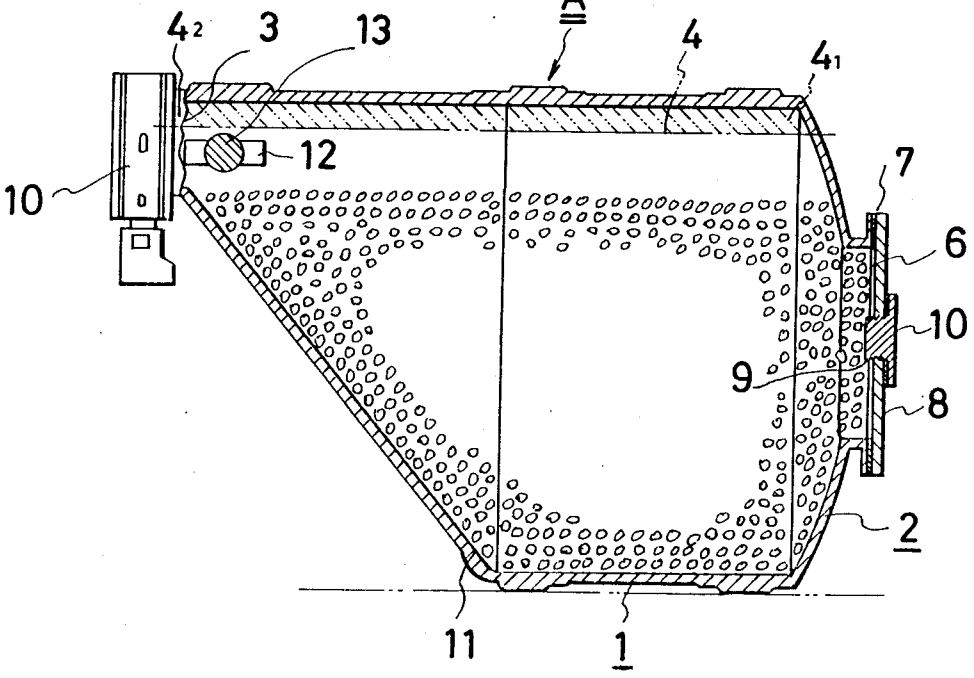
FIG. 3 is a longitudinal sectional elevational view of the hopper when being transported.

The exemplary embodiment is constituted as above, and the hopper combined with tank is in a reclined position such that the vertical line portion 4 is positioned along the upper surface (i.e. the discharge port 3 is located at an upper side) for transportation as shown in FIG. 3, and the iodine 11 will be loaded only up to a predetermined level so that the surface of the iodine 11 placed is at a level lower than the discharging port 3 in this position. This will prevent clogging of iodine 11 in the discharging port 3 due to vibrations, etc., during transportation and prevent the discharge of iodine.

When discharging the iodine, the hopper combined with tank A is reclined at the required facility so that the discharging port 3 is located at a lower position, and the valve 10 is opened to discharge the iodine. During reclining of the hopper combined with tank A, the iodine 11 will shift downward from the upper position to the side of discharging port 3 as if collapsing, and the solidified portion will also shift downward. When discharging is not performed smoothly, the paddle bar 13 will be rotated to agitate the iodine 11 by paddle plate 12, so that the discharge of iodine 11 will be promoted.

Figure 5:
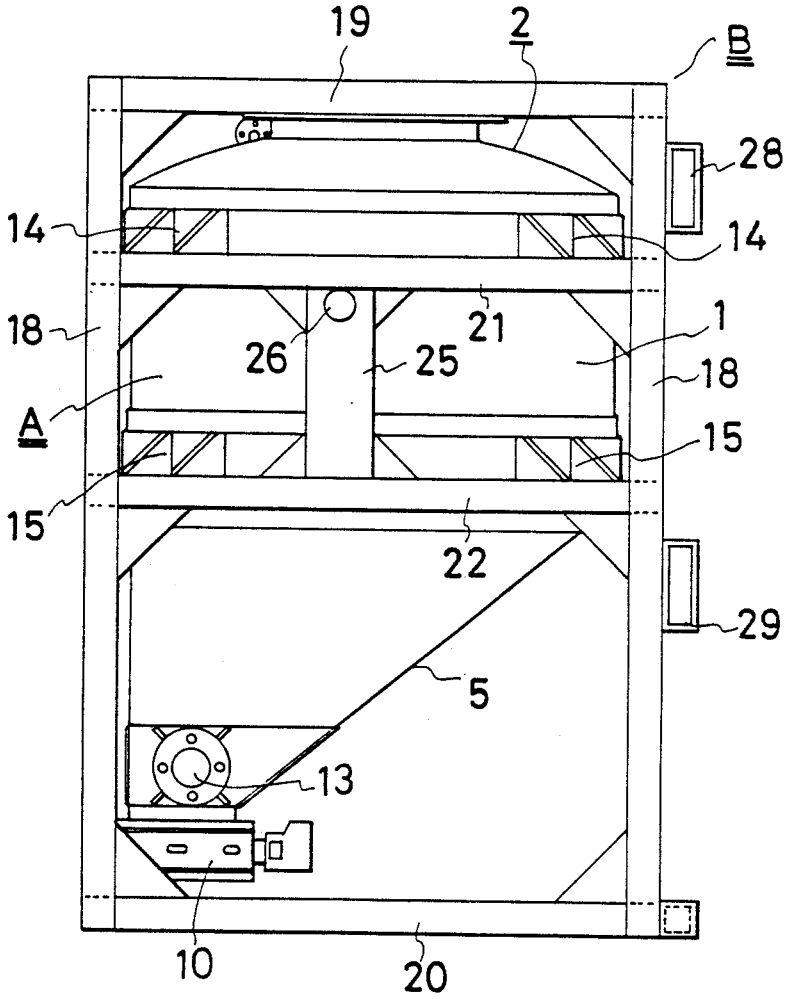
FIG. 5 is an elevational view of the frame body of FIG. 4.
Figure 6:
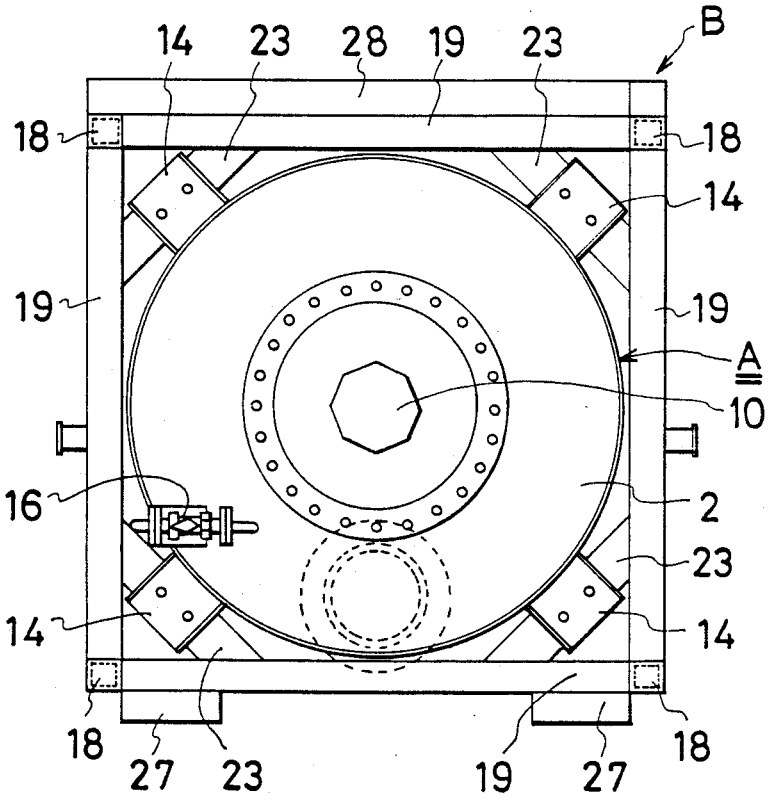
FIG. 6 is a plan view of the frame body of FIG. 4.

Now, an exemplary embodiment of the frame B used for the transportation of above hopper combined with tank A will be described in accordance with FIGS. 4–6.

The frame body B is constituted by placing square type struts 18, 18, at the four corners, and connecting the struts by end cleats 19, 19; 20, 20. In two places between the middle of the height of the strut and upper end, and between the middle of the height of the strut and lower end, supporting cleats 21, 21; 22, 22, are fixed horizontally. In addition, supporting plates 23, 23; 24, 24, are fixed to the four corners of each of the supporting cleats 21, 21; 22, 22, so that the supporting plates are connected to each side of supporting cleats 21, 21, 22, 22. Upper and lower brackets 14, 14; 15, 15, connected to the hopper combined with tank A are mounted on the supporting plates and are secured by bolts and nuts (not shown).

A first hook supporting plate 25 is fixed between one side of supporting cleats 21 and 22, and is fixed at a location shifted slightly from the center, and a projecting 26 hook is fixed to the upper part of the supporting plate 25 so that the hook 26 project in a radially outward direction. A second supporting plate 25 is fixed to the other supporting cleats 21, 22 which are located opposite to the supporting cleats 21, 22 and a second projecting hook 26 is connected to supporting plate 25.

In addition, rectangular shaped fork insertion members 27, 27, having holes for insertion of a forklift fork, are attached to opposite sides of the lower side lateral cleats 20 parallel to a line connecting both projecting hooks 26, 26. Moreover, fork insertion members 28 are located on struts 18, 18. Fork insertion member 29 is fixed at a position a little lower than the supporting cleat 22.

To insert and fix the hopper combined with tank A into the frame body B constituted as above, vertical line part 4, brackets 14, 14; 15, 15 of the hopper combined with tank A are mounted on the supporting plates 23,23; 24, 24, respectively and are fixed in place. Then the fork inserting members 28, 29 are shifted so as to contact the ground for transportation purposes. In the case where dispensing of the iodine is required, the forks of a forklift are inserted into the fork insertion members 28, 29, and also hooks of a crane (not shown) engage the projecting hooks 26, 26, and the frame body B is oriented so that the discharging port 3 is located at a lower position, connected to the valve 10 to the vessel, duct, etc., as required, and discharge of the iodine 11 occurs by opening the valve 10.

In this invention, the hopper combined with tank A is transported in the rotated or toppled position with the discharging port 3 on the upward side. In this case iodine 11 is loaded so that it is at a level lower than the discharging port 3, therefore, clogging of the iodine in the discharging port 3 will not occur.

Moreover, when the hopper combined with tank A is rotated or placed in an upright position when it is necessary to discharge the iodine, the iodine will shift down to the side of discharging port 3. Therefore, should the iodine become solidified due to vibrations during the transportation, the iodine of a solidified condition will automatically be shifted downward upon placing the hopper and tank A in an upright position and will allow for the discharge to be smoothly performed.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters patent of the United States is:

1. A transportable hopper and tank assembly positionable in an upright or a reclined portion comprising:

a tank having a side wall;

a cover body located at a top end portion of said side wall when said tank is in said upright position and having an opening formed in said cover body;

a discharge port formed at a lower portion of said tank in said upright position and having an area smaller than said cover body;

a discharge valve located adjacent said discharge port wherein said side wall includes an upper and lower vertical side wall and a second lower side wall positioned opposite said lower vertical side wall wherein said second lower side wall converges downwardly toward said lower vertically side wall when said tank is in said upright position;

a rotatable paddle plate positioned in said discharge port so as to promote discharge of material confined within said tank;

a cover plate for covering said opening in said cover body, said cover plate having a filler port;

a plug mmber removably positioned in said filler port; and frame means connected to said tank and upon which said tank is mounted, said frame means surrounding said tank on all sides thereof and at four corners thereof in an upright position and which includes at least one pair of fork insertion members and a pair of engaging means for orienting said tank from said reclined position to said upright position.

* * * * *

UNITED STATES PATENT AND TRADEMARK OFFICE

CERTIFICATE OF CORRECTION

PATENT NO. : 4,836,421

DATED : June 6, 1989

INVENTOR(S) : Masazumi Miyoshi, et al

It is certified that error appears in the above-identified patent and that said Letters Patent is hereby corrected as shown below:

On the Title Page, Item [75], the fourth inventor's name is incorrect, it should read as follows:

--TERUTADA OHTA--

Signed and Sealed this

Twentieth Day of March, 1990

*Attest:*

JEFFREY M. SAMUELS

*Attesting Officer*

*Acting Commissioner of Patents and Trademarks*